United States Patent [19]

Serkov et al.

[11] 4,045,532

[45] Aug. 30, 1977

[54] PROCESS OF PRODUCING VISCOSE YARN

[76] Inventors: Arkady Trofimovich Serkov, prospekt Mira, 13/19, kv. 20; Gennady Alfeevich Budnitsky, ulitsa Onezhskaya, 55, kv. 45, both of Moscow; Boris Matveevich Sokolovsky, ulitsa Pervomaiskaya, 27, kv. 71, Mytischi Moskovskoi oblasti; Vyacheslav Kapitonovich Lezhnev, ulitsa Osipenko, 9, kv. 57, Moscow, all of U.S.S.R.

[21] Appl. No.: 518,793

[22] Filed: Oct. 29, 1974

[51] Int. Cl.[2] ..... D01F 2/06

[52] U.S. Cl. ..... 264/196; 264/38; 264/233

[58] Field of Search ..... 264/188-198, 264/38, 233

[56] References Cited

U.S. PATENT DOCUMENTS

| | | | |
|---|---|---|---|
| 1,214,931 | 2/1917 | Leduc et al. | 264/38 |
| 2,488,665 | 11/1949 | Heim | 264/169 |
| 2,494,468 | 1/1950 | Borzykowski | 264/188 |
| 2,519,382 | 8/1950 | Kuljian | 264/38 |
| 2,683,072 | 7/1954 | Clark | 264/38 |
| 3,109,699 | 11/1963 | Richardson | 264/198 |

FOREIGN PATENT DOCUMENTS

| | | | |
|---|---|---|---|
| 965,660 | 8/1964 | United Kingdom | 264/38 |

*Primary Examiner*—Jay H. Woo
*Attorney, Agent, or Firm*—Fleit & Jacobson

[57] ABSTRACT

A continuous process for producing viscose yarn including feeding a viscose solution through spinneret dies into a spinning bath to spin viscose yarn, and finally regenerating and concurrently cooling the spun yarn, now carrying entrapped carbon bisulfide in the form of an emulsion, from said spinning bath at a temperature below the boiling point of the carbon bisulfide. Thereafter, while maintaining the finally regenerated yarn in a cooled condition, washing the yarn with water whereby some water, in addition to the carbon bisulfide, becomes entrapped in the yarn, subjecting the washed yarn to avivage treatment, and finally drying the resulting yarn at an elevated temperature sufficient to concurrently remove both the entrapped water and the carbon bisulfide from the yarn. Thereafter, the resulting dried and carbon bisulfide-free yarn is wound into a package.

2 Claims, 1 Drawing Figure

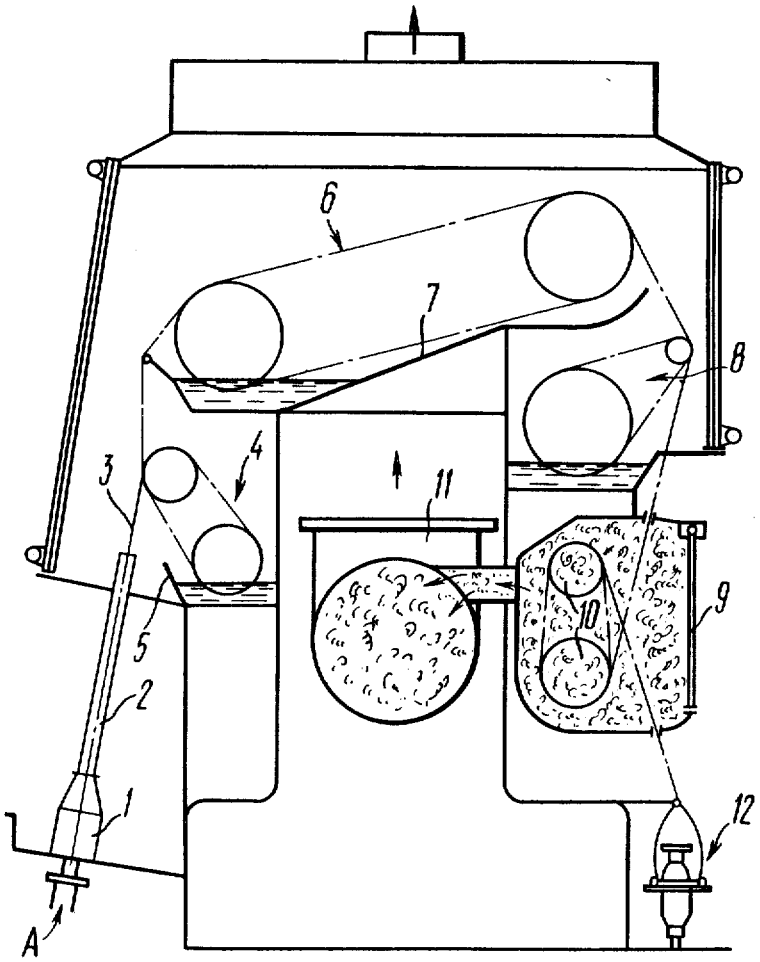
6
7
8
4
3
11
10
9
5
2
1
12
A

PROCESS OF PRODUCING VISCOSE YARN

The present invention relates to methods of manufacturing artificial yarn, and more particularly to a process of producing viscose yarn. The invention may be most advantageously used with the utmost success in a continuous process for the production of viscose yarn.

At present, a continuous process of producing viscose yarn has found a wide range of application.

This process comprises the step of passing a viscose solution through spinneret holes into a spinning bath to spin yarn therein, with subsequent final regeneration thereof. Then carbon bisulphide is removed from the yarn, and the yarn is subsequently subjected to washing, avivage treatment and drying. Then the finished yarn is wound into packages.

However, such a sequence of steps in producing viscose yarn lengthens the technological process of making the yarn. The removal of carbon bisulfide from yarn between the final regeneration and washing steps results in an increased complexity of the equipment used to produce the yarn since, in addition to a chamber for drying yarn, it also requires still another sealed chamber having means for raising the temperature therein and means for removing carbon bisulphide released from the yarn. Therefore, the removal of carbon bisulphide from yarn prior to the washing step, in addition to the need for complex equipment, results in a greater power consumption for raising temperatures in the chambers, because by such a method the spun yarn is heated twice.

It is an object of the present invention to provide a process of producing continuously moving viscose yarn which enables a considerable time saving in the production cycle for producing the yarn due to the combining of several steps into one step, the reduction of power consumption, as well as simplification of the equipment employed for producing such yarn.

In accordance with the above and other objects, there is provided, in a process of producing viscose yarn which comprises the steps of continuously feeding a viscose solution through spinnerets into a spinning bath for spinning yarn, with subsequent final regeneration thereof, washing, avivage treatment and drying, according to the invention, a cooling of the yarn during the final regeneration, to a temperature below the boiling point of carbon disulphide, with subsequent washing and avivage treatment of the cooled yarn, and the drying is conducted at a temperature sufficient for concurrent removal of water and carbon bisulphide from the yarn. The term "avivage treatment" as used herein throughout the specification and claims, means the treatment of fibers with aqueous solutions or emulsions of fatty-like chemical reagents for reducing their brittleness and stiffness and imparting good passability to them in textile processing.

The cooling of yarn immediately after the spinning thereof contributes to the reduction of power consumption in producing the yarn since the high temperature treatment of the yarn upon leaving the spinning bath can be dispensed with, while the yarn is heated only once during the drying step, where carbon bisulphide is removed from the yarn along with water.

The concurrent performance of the drying and carbon bisulphide removal steps results in a considerable time saving in producing the yarn, since one independent step is completely eliminated.

The temperature, at which the yarn is preferably cooled, is approximately 15°-20° C below the boiling point of carbon bisulphide.

Thus, the process of producing viscose yarn according to the invention permits the release of noxious gas (carbon bisulphide) to be localized at two points, of which one is located in the yarn spinning zone, and the other in the drying zone. During the washing of yarn conducted at a temperature about 15°-20° C below the boiling point of carbon bisulphide, there is substantially no release of noxious gas. In addition, there are provided the conditions for creating a simpler high-speed spinning machine since there is no need in a special assembly for performing one of the most complicated operations — i.e., the removal of carbon bisulphide from yarn at high temperatures.

The process according to the invention may find its application in industry in existing spinning machines without any substantial reconstruction thereof and with slight modifications only.

The invention will now be described with reference to specific embodiments thereof illustrated in the accompanying drawing schematically showing an apparatus for carrying out the process of producing viscose yarn according to the invention.

To produce viscose yarn, conventional equipment is used which is installed in an order defined by the production method of producing such yarn in accordance with the process of the invention.

This equipment comprises a spinneret 1, a pipe 2 in which a yarn 3 is spun, a pair of rollers 4, a bath 5, a pair of rollers 6, a bath 7, an avivage treatment apparatus 8, a chamber 9 for drying yarn having rolls 10 and an exhaust blower 11.

A solution of viscose is fed in the direction indicated by arrow A through the spinneret 1 into a spinning bath which is formed by the pipe 2 which contains a spinning solution at a temperature below 60° C. In the spinning bath, the yarn 3 is spun and subsequently fed from the pipe 2 and wound in two or three turns on the pair of rollers 4, where the yarn is completely regenerated and cooled, one of the rollers of the pair 4 being partially immersed in the bath 5 containing a weak acid solution at a temperature of about 15°-20° C below the boiling point of carbon bisulphide which is formed in the yarn during its formation, carbon bisulphide having a boiling point of 46.3° C.

Subsequently, the cooled yarn 3 is wound in a few turns on the pair of rollers 6, one of which is partially immersed in the bath 7 containing water at a temperature below the boiling point of carbon bisulphide. The yarn is washed on these rollers and is then fed in the pure state into a avivage treatment apparatus 8, wherein a brightening avivage treatment is conducted also at a temperature below the boiling point of carbon bisulphide. It should be noted that the major part of carbon bisulphide in an amount of 65% of a specific total content thereof remains in the yarn in the form of an emulsion due to its slight solubility, in spite of the fact that all of the soluble impurities on the yarn have already been washed off (it is assumed that, generally, 35% of the carbon disulphide has been released from the yarn in the pipe 2). The yarn thus treated is then fed for drying into the chamber 9.

The yarn is dried by a known contact method on the rolls 10 heated with steam with the surface temperature at 100° C, that is at a temperature above the boiling point of carbon bisulphide.

During the drying, carbon bisulphide is removed from the yarn along with water and is discharged from the chamber 9 by means of the exhaust blower 11 for recovery, and the yarn 3 is fed into a receiving winder 12 for winding into packages.

Therefore, by the process of producing viscose yarn according to the invention, the high-temperature treatment of yarn for removal of carbon bisulphide therefrom is performed concurrently with the drying step, such known operations as spinning, final regeneration, washing, avivage treatment and drying being not described herein, as these operations are well known to those skilled in the art.

EXAMPLE 1

A solution of viscose containing 7.5% by weight of α-cellulose and 6.3% alkali 6.3, with a ball viscosity of 40 sec and a 6.3% by eight of alkali, with a ball viscosity of 40 sec and a 6.3% by weight of alkali, with ball viscosity of 40 sec and a spinneret die having thirty apertures of 0.08 mm diameter to spin a 13 tex yarn in a spinning bath with a specific gravity of 1.260 and a composition including 145 grams per liter of sulphurric acid, 18 grams per liter of zinc sulphate, the temperature of the spinning bath being 50° C. Upon leaving the spinning bath, the yarn was wound in two or three turns on rollers immersed in a weak acid solution at 30° C.

Then the yarn was washed and subjected to avivage treatment, with the temperature of the avivage treatment solution being 21° C. After the avivage treatment, the yarn contained 45% of that amount of carbon bisulphide specified for xanthation. The yarn with the above-mentioned content of carbon bisulphide was fed into a chamber for drying.

During the drying conducted at 100° C, carbon bisulphide was removed from the yarn along with water.

The dried yarn was then wound into packages, and the resulting air-vapour mixture was removed for recovery.

EXAMPLE 2

The spinning of yarn from a viscose solution, its final regeneration and cooling were conducted as described in Example 1. After the final regeneration, the yarn was washed with water at 31° C and treated with an avivage solution at a temperature equal to the water temperature, whereafter the yarn was fed into a drying chamber. The content of carbon bisulphide in the yarn prior to drying was 48% of that amount specified for xanthation. During the drying, carbon bisulphide was removed from the yarn along with water, the resulting air-vapour mixture being removed for recovery, and the dried yarn being wound into packages.

What is claimed is:

1. A process of producing viscose yarn comprising providing a spinning bath, feeding a viscose solution through spinneret dies into said spinning bath to spin viscose yarn, finally regenerating and concurrently cooling the spun yarn, now carrying entrapped carbon bisulfide in the form of an emulsion, from said spinning bath at a temperature below the boiling point of the carbon bisulfide, then, while maintaining the finally regenerated yarn in the cooling condition, washing the yarn with water whereby some water, in addition to the carbon bisulfide, is also entrapped in the yarn and subjecting the thus-washed yarn to avivage treatment, drying the resulting yarn at an elevated temperature sufficient to concurrently remove both the entrapped water and carbon bisulfide from the yarn, and winding the resulting dried, carbon bisulfide-free yarn into a package.

2. The process of claim 1 wherein the concurrent regenerating and cooling steps are carried out at a temperature between about 15° and 20° C. below the boiling point of the carbon bisulfide.

* * * * *